US005482101A

United States Patent [19]

Fink

[11] Patent Number: 5,482,101

[45] Date of Patent: Jan. 9, 1996

[54] PRESSING-IN DEVICE

[75] Inventor: Roland Fink, Winterbach, Germany

[73] Assignee: Oskar Frech GmbH & Co., Schorndorf, Germany

[21] Appl. No.: 218,593

[22] Filed: Mar. 28, 1994

[30] Foreign Application Priority Data

Mar. 30, 1993 [DE] Germany ..... 43 10 310.3

[51] Int. Cl.[6] ..... B22D 17/00

[52] U.S. Cl. ..... 164/312; 164/319

[58] Field of Search ..... 164/312, 313, 164/316, 317, 319, 113, 120

[56] References Cited

FOREIGN PATENT DOCUMENTS

| | | |
|---|---|---|
| 292222 | 8/1971 | Austria . |
| 0430616 | 6/1991 | European Pat. Off. . |
| 1804261 | 5/1970 | Germany . |
| 2922914 | 6/1990 | Germany . |
| WO91/06415 | 5/1991 | WIPO . |

OTHER PUBLICATIONS

Dubbel, entitled "Taschenbuch für den Maschinenbau" (Manual for Machine Construction) by W. Beitz and K.-H. Küttner, 14th Edition, Springer Publishers, New York, 1981, pp. 983 and 984.

*Primary Examiner*—Kuang Y. Lin

*Attorney, Agent, or Firm*—Evenson, McKeown, Edwards & Lenahan

[57] ABSTRACT

Pressing-in devices of pressure die casting machines operate as hydraulically driven multiphase as pressing-in systems in order to exercise a different pressure on the casting material during different phases of the casting operation. The casting piston of a pressing-in device is driven by at least one electric motor. In this case, the drive advantageously takes place using a multispeed servomotor which interacts with a multiple-roll spindle.

9 Claims, 2 Drawing Sheets

PRESSING-IN DEVICE

BACKGROUND AND SUMMARY OF THE INVENTION

This invention relates to a pressing-in device for a pressure die casting machine, comprising a casting piston for pressing casting material into the mold of a pressure die casting machine.

Modern pressing-in devices of pressure die casting machines are conceived as multi-phase pressing-in systems, particularly three-phase systems. In this case, in a first slow lead phase, the casting piston is moved forward until the casting material arrives at the gate, whereas, in the second phase, it is pressed into the mold cavity of the closing part with a short filling time and at a high pressing-in speed. In a third phase, a compression of the die-cast part which is decisive for the quality of the cast products takes place under high pressures. For implementing these phases, the casting piston is connected with a high-cost hydraulic system which comprises several pressure accumulators as well as control and regulating devices.

A pressing-in device of the above-mentioned type is known from German Patent document DE 29 22 914 C2. In the case of this known pressing-in device, three pressure accumulators are provided. The pressure accumulators are connected with the casting piston cylinder via various lines provided with return valves, seat valves and control valves. In this case, the pressure medium from the first pressure accumulator moves the casting piston from an inoperative position into a position in which the casting material is at the gate, whereupon, after the change-over of a seat valve, the pressure medium is guided out of the second pressure accumulator under high pressure and at a high speed onto the casting piston so that the casting material is rapidly injected into the mold. For the implementation of the third phase, another seat valve is then switched. This seat valve is connected in front of the third pressure accumulator so that the pressure existing in the third pressure accumulator can be transmitted to a multiplier piston and can be transmitted by this multiplier piston to the casting piston while utilizing a transmission ratio. As a result, the casting piston, which is in its end position, subjects the casting material already injected into the mold to a very high pressure. Thereby, high quality casting is achieved. In this case, the control of the different pressure phases is carried out as a function of the path covered by the casting piston. The position of the piston rod of the casting piston must therefore be monitored by separate devices. In the case of these constructions, it is a disadvantage that, because of the high temperatures in the area of the pressure die casting machines, so-called water glycols are used instead of oil as the hydraulic fluid. These water glycols are not as flammable as oil, but are more harmful to the environment and, if any seals are damaged, may also harm the operator's health.

For machine tools, and also for screw presses (see: Dubbel, "Taschenbuch für den Maschinenbau" ("Manual for Machine Construction"), 14th Edition, Springer Publishers '81, Pages 983 and 9804), it is known to use electric motors as drives. However, different conditions exist in the above machine tools than in the case of pressing-in devices for pressure die casting machines. For the above machine tools, for example, the feed motion of the pressing head may be carried out at a relatively high adjusting speed. However, in this case, the spindle does not have to apply large forces. If such large forces become necessary during the deformation operation, the spindles run relatively slowly. Because of the engaging of transmissions, commercially available electric motors may therefore be used. This is not possible in the case of pressure die casting machines because of the required injection speeds for the casting material and because of the high pressures which must therefore be exercised.

There is therefore needed a pressing-in device of the above-mentioned type wherein the use of a hydraulic fluid is no longer necessary, without any impairment of the prerequisites which exist for the pressure die casting operation.

For achieving this need, at least one electric motor is provided as a drive for the casting piston. Because of the use of an electric motor as the drive of the casting piston, the casting piston movement can be controlled in a precise manner. The construction of the pressing-in device is simplified because a high-cost hydraulic system is no longer necessary. The use of a hydraulic fluid, which is harmful to the environment, is avoided. Finally, the rotating movement of the electric motor may also directly be utilized for the control of the casting operation. The respective position of the piston rod of the casting piston can be determined from the number of revolutions. In this case, it was found to be particularly advantageous and suitable for the drive of the pressing-in device of a pressure die casting machine to use an electric motor which drives the casting piston via a spindle or a toothed rack, in which case it is particularly advantageous to use a recirculating ball screw as a spindle. In the case of this development, high advancing speeds are implemented in the case of very high pressures, as required for pressure die casting machines and as explained above.

The use of an electric motor becomes possible particularly because the sensitive thread portion of the spindle, which extends within the nut provided in the case of a recirculating ball screw, is completely encapsulated and therefore outwardly protected. The contaminations which occur in the rough casting operation and which are otherwise hard to keep away from the drive, will have no damaging influence on the drive in this manner.

A further development provides a gear reduction between the electric motor and the casting piston. As a result, different pressures can be achieved because of different torque forces, so that the drive can also be used in the case of larger machines.

In the case of another embodiment, the electric motor may be a multispeed electric motor permitting the initially mentioned output adaptation required in the case of the pressing device of pressure die casting machines with respect to the speeds as well as with respect to the forces to be generated.

Finally, water cooling may be provided for the electric motor itself, in the event its power has to be increased.

Other objects, advantages and novel features of the present invention will become apparent from the following detailed description of the invention when considered in conjunction with the accompanying drawings.

DETAILED DESCRIPTION OF THE DRAWINGS

Figure 1:
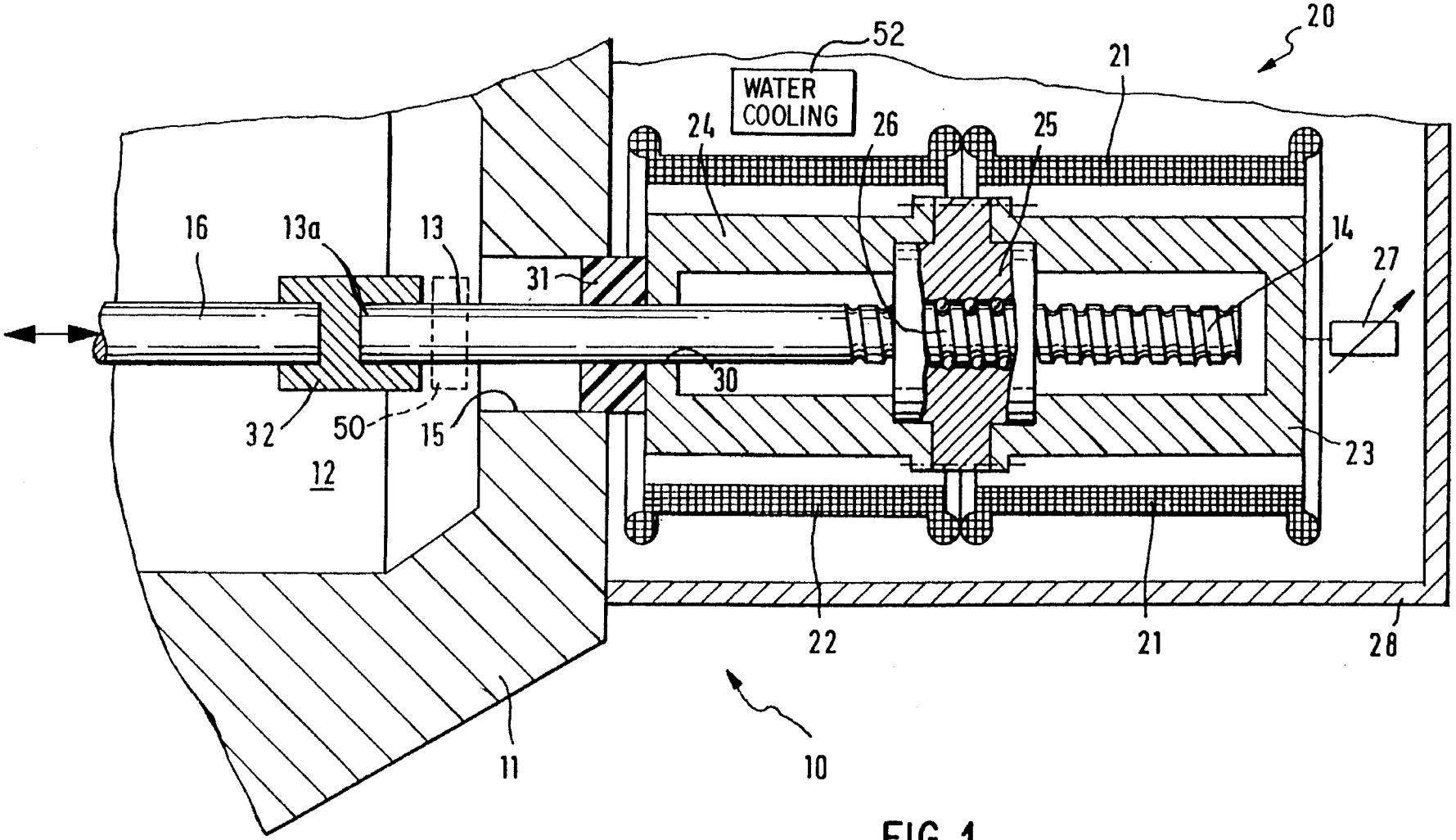
FIG. 1 is a cutout of a cross-sectional view of a pressing-in device according to the present invention, which comprises a recirculating ball screw driven by an electric motor.

The pressing-in device 10 illustrated in FIG. 1 comprises an electric motor 20 arranged inside a housing 28. The electric motor 20 is constructed as a two-speed servomotor with two stators 21, 22 and with rotors 23, 24 which are assigned to these stators. The rotors 23, 24 are fixedly connected with a nut 25. The nut 25 is arranged between the rotors 23, 24 and receives, by means of a thread 26, a threaded portion 14 of a recirculating ball screw spindle 13. The spindle 13 extends coaxially to the axis of rotation of the rotors 23, 24. The rotors 23, 24 have a hollow construction and form a protective housing for the threaded portion 14 of the spindle 13. The protective housing completely encapsulates the threaded portion 14. Only the smooth shaft of the spindle 13 is guided tightly out of a bore 30 on one of the end faces of the rotor housing. The spindle shaft, which is led through the bore 30 out of the area of the rotors 23, 24, extends through an opening 15 of a housing 11 of the casting chamber. This opening 15 is provided with a sealing 31. The spindle 13 further extends into the interior 12 of the casting chamber. Another seal may be provided at the bore 30. The end 13*a* of the spindle 13 is firmly connected in the interior 12 of the casting chamber with an end of a piston rod 16 via a coupling 32.

At the other end of the piston rod 16, which is not shown, the casting piston is arranged. The casting piston is used, as described above, to press the casting material from the interior of the casting chamber into the mold. A closing part for such a mold is familiar to a person of ordinary skill in the art and is known, for example, from International Patent document WO 91/06 415 A1.

For driving the casting piston, the spindle 13 and therefore also the piston rod 16 are caused to carry out a longitudinal movement in the direction of the indicated double arrow through the rotation of the nut 25 which is fixedly connected with the rotors 23, 24 of the electric motor 20. Using a regulating and control device 27, the electric motor 20 can be operated at two speeds. Its power may be changed by connecting or disconnecting the second stator. Via the electric motor 20, the casting piston can therefore be acted upon at different speeds as well as by means of different forces. In this manner, the phases of movement and phases of exercising pressure on the casting piston when an electric motor is used, which are important for the pressing-in operation, are achieved without any disadvantageous influences on the drive which can be caused by the high casting temperature or by contaminations. This is accomplished because of the encapsulation of the thread portion 14 of the spindle 13.

The spindle 13 is constructed as a recirculating ball screw. This is explained in detail by means of FIG. 2. By means of this development, the power transmission from the electric motor 20 to the casting piston is significantly improved. A gear reduction 50 can be provided between the electric motor 20 and the casting piston 16.

The embodiment illustrated in FIG. 1 shows a two-speed servomotor. Other electric drives may also be used without departing from the scope of the invention. Furthermore, two or more electric motors with different reduction gears can be connected to the recirculating ball screw 13. Water cooling 52 can also be provided for the electric motor 20.

Figure 2:
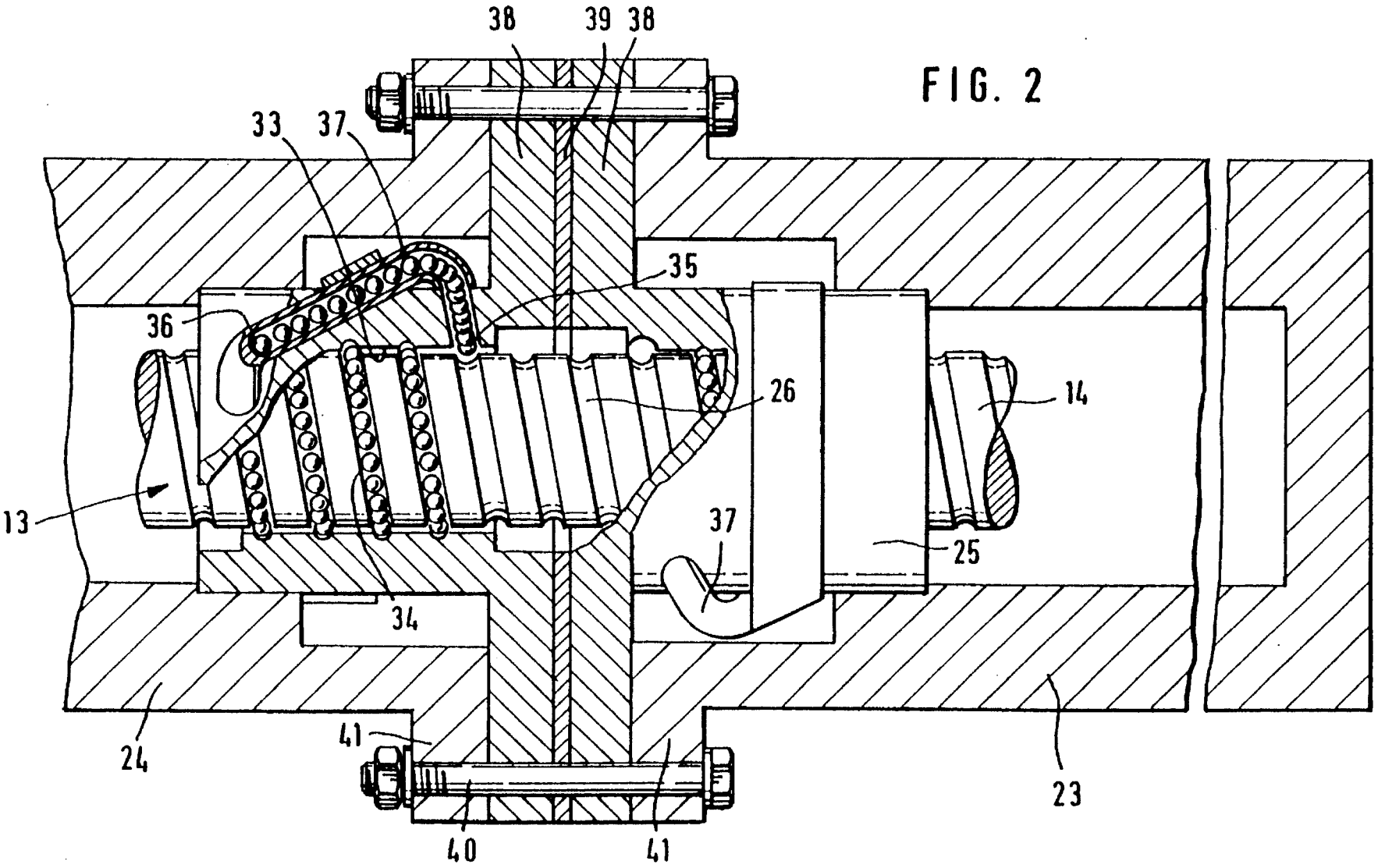
FIG. 2 is an enlarged representation of the area of the nut of the recirculating ball screw as shown in FIG. 1.

FIG. 2 shows that, according to the principle of a recirculating ball screw, the threaded portion 14 is equipped with a high-precision thread. The turns of the high-precision thread have a cross-section which is adapted to the recirculation of balls 34 and which continues in a corresponding thread 33 on the internal side of the nut 25. In this case, the balls 34 are guided in a known recirculating manner in the runs of the spindle 13 and in the corresponding runs 33 of the nut 25. The balls 34 leave the runs at point 35, and are guided via a deflecting channel 37 to an inlet point 36. From the inlet point 36, they return to their runs in the case of a rotation of the nut which is triggered by the rotating movement of the rotors 23, 24. By means of these balls 34, a form-locking engagement is obtained between the nut 25, on the one hand, and the spindle 13, on the other hand. As indicated in FIG. 2, the nut 25 comprises two parts which adjoin one another by means of a flange 38 and are held, with the interposition of a prestress adjusting disk 39, by means of studs 40. The studs 40 extend through flanges 41 of the rotors 23, 24 and through the flanges 38 of the two nut parts.

In the above-described manner, the nut 25 is non-rotatably connected with the rotors 23, 24. Therefore, when the stators 21, 22 are acted upon individually or jointly or when, in a manner which is also known, a corresponding control of the rotors 23, 24 takes place, the nut 25 is also caused to carry out corresponding rotating movements. By means of this rotating movement, the spindle 13 is caused to carry out an axial movement in the desired manner which moves the casting piston.

It is clear that when high rotational speeds are selected, very high advancing speeds for the casting piston can also be achieved depending on the design of the electric drive. By means of the combination of several stators and/or rotors, correspondingly high torques can also be implemented. These torques which can also implement the required high pressures for the pressing-in operation.

In addition to the above-mentioned advantages, it is also an advantage of the use of an electric motor for driving the casting piston that a driving pressure for the casting piston does not have to be built up first, as this is the case in hydraulic drives. Rather, the casting piston can be caused to always be rotated by means of a precisely defined power as a function of being acted upon by the voltage. Furthermore, it is easy to determine the parameters which are important for the control of the pressing-in device 10. Since the nut 25 is always connected with the spindle 13, the number of revolutions of the nut 25 or of the rotors 23, 24 supplies clear information concerning the position of the casting piston in the pressing-in device. Through the use of a rotational speed sensor, the rotational speed and therefore the position of the casting piston can be determined at any time. In a known manner, this can be utilized for the control without the requirement of special measures for detecting the position of the casting piston.

The pressing-in device according to the present invention may be used in hot-chamber die casting machines as well as in cold-chamber die casting machines.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An apparatus comprising:

a pressure die casting machine;

a pressing-in device for said pressure die casting machine, said pressing-in device comprising a casting piston for pressing casting material into a mold, and an electric motor for driving said casting piston via a spindle interacting with a nut;

wherein the nut for the spindle is fixedly connected with rotors of the electric motor, said nut engaging with a threaded portion of the spindle, and wherein said rotors form a protective housing completely enclosing the threaded portion of the spindle.

2. An apparatus according to claim 1, wherein the spindle is a recirculating ball screw.

3. An apparatus according to claim 1, wherein a piston rod of the casting piston is constructed as a spindle.

4. An apparatus according to claim 1, wherein the spindle extends through an opening of a housing of a casting chamber and is axially connected to a piston rod connected with said casting piston.

5. An apparatus according to claim 1, wherein the spindle is arranged coaxially with respect to an axis of said rotors, and is guided outwardly in a sealed manner through a face-side opening in one of the rotors.

6. An apparatus according to claim 1, wherein an axial length of an inner cavity of the rotors is coordinated with a maximal stroke length of the spindle in such a manner that the threaded portion of the spindle always remains inside the protective housing formed by the rotors.

7. An apparatus according to claim 1, further comprising a gear reduction, said gear reduction being connected between the electric motor and the casting piston.

8. An apparatus according to claim 1, wherein the electric motor is constructed as a multispeed drive.

9. An apparatus according to claim 1, wherein water cooling is provided for the electric motor.

* * * * *